US010669781B2

(12) United States Patent
Lyon

(10) Patent No.: US 10,669,781 B2
(45) Date of Patent: Jun. 2, 2020

(54) DOWN-THE-HOLE DRILL HAMMER HAVING A ROLLER BEARING ASSEMBLY

(71) Applicant: Center Rock Inc., Berlin, PA (US)

(72) Inventor: Leland H. Lyon, Roanoke, VA (US)

(73) Assignee: Center Rock Inc., Berlin, PA (US)

( * ) Notice: Subject to any disclaimer, the term of this patent is extended or adjusted under 35 U.S.C. 154(b) by 124 days.

(21) Appl. No.: 15/850,803

(22) Filed: Dec. 21, 2017

(65) Prior Publication Data

US 2018/0171720 A1 Jun. 21, 2018

Related U.S. Application Data

(60) Provisional application No. 62/438,100, filed on Dec. 22, 2016, provisional application No. 62/437,425, filed on Dec. 21, 2016.

(51) Int. Cl.

| | |
|---|---|
| ***E21B 10/22*** | (2006.01) |
| ***E21B 10/38*** | (2006.01) |
| ***E21B 10/44*** | (2006.01) |
| ***E21B 4/14*** | (2006.01) |

(52) U.S. Cl.

CPC ..... *E21B 10/22* (2013.01); *E21B 4/14* (2013.01); *E21B 10/38* (2013.01); *E21B 10/445* (2013.01)

(58) Field of Classification Search

CPC ..... E21B 4/14; E21B 10/38; E21B 10/445

See application file for complete search history.

(56) References Cited

U.S. PATENT DOCUMENTS

| | | | | |
|---|---|---|---|---|
| 4,726,429 | A * | 2/1988 | Kennedy | E21B 4/14 173/62 |
| 5,711,205 | A | 1/1998 | Wolfer et al. | |
| 8,397,839 | B2 | 3/2013 | Lyon | |
| 2010/0200301 | A1* | 8/2010 | Lyon | E21B 4/14 175/296 |
| 2014/0169718 | A1* | 6/2014 | Peterson | F16C 33/32 384/569 |
| 2016/0222732 | A1 | 8/2016 | Lyon | |

* cited by examiner

*Primary Examiner* — Giovanna C Wright
*Assistant Examiner* — Brandon M Duck
(74) *Attorney, Agent, or Firm* — Kim IP Law Group PLLC

(57) ABSTRACT

A down-the-hole drill hammer is provided that includes a housing, a drill bit proximate a distal end of the housing, and a roller bearing assembly. The roller bearing assembly circumscribes the drill bit. The roller bearing assembly includes a race and a plurality of rollers. The plurality of rollers are operatively engaged with the race.

20 Claims, 11 Drawing Sheets

DOWN-THE-HOLE DRILL HAMMER HAVING A ROLLER BEARING ASSEMBLY

CROSS-REFERENCE TO RELATED APPLICATIONS

This application claims the benefit of U.S. Provisional Application No. 62/437,425, filed Dec. 21, 2016, and U.S. Provisional Application No. 62/438,100, filed Dec. 22, 2016, the entire disclosures of which are incorporated by reference herein in their entirety.

BACKGROUND OF THE INVENTION

The subject disclosure relates generally to down-the-hole drill ("DHD") hammers. In particular, the subject disclosure relates to a DHD hammer having an internal roller bearing assembly between a drill bit and a chuck.

Typical DHD hammers involve a combination of percussive and rotational movement of the drill bit to drill or chip away at rock. Such DHD hammers are powered by a rotatable drill string attached to a drilling platform that supplies rotation and high pressure gases (e.g., air) for percussive drilling. Moreover, in percussive drilling, rock cutting is a result of percussive impact forces rather than shear forces. In other words, rotation of the DHD hammer serves to rotationally index the drill bit to fresh rock formations after the drill bit impacts a rock surface rather than to impart shear cutting forces to the rock surface.

Such DHD hammers typically include an internal bearing for maintaining the drill bit centrally aligned about the DHD hammer's central longitudinal axis. However, such internal bearings are typically only designed to provide axial alignment and are not capable of carrying substantial side loads which leads to a relatively short life span for such components.

BRIEF SUMMARY OF THE INVENTION

In accordance with an exemplary embodiment, the subject disclosure provides a down-the-hole drill hammer having a housing, a drill bit proximate a distal end of the housing, and a roller bearing assembly circumscribing the drill bit. The roller bearing assembly includes a race and a plurality of rollers operatively engaged with the race.

In accordance with an aspect of the exemplary embodiment, the race is connected to the housing. For example, the race is fixedly connected to the housing. The race circumscribes the drill bit. The race circumscribes the plurality of rollers. The race circumscribes a shank of the drill bit. The race includes a distal end having a circumferential recess for engaging the plurality of rollers and a proximal end connected to the housing. The proximal end of the race includes threads for engaging the housing.

In accordance with another aspect of the exemplary embodiment, the drill bit includes a shank having a recess circumscribing the shank and defining an inner race for engaging the plurality of rollers. Alternatively or in addition to, the drill bit includes a shank having a plurality of grooves circumscribing the shank and configured to receive the plurality of rollers. The plurality of rollers includes at least 4 rollers. A longitudinal axis of each of the plurality of rollers is substantially parallel with a longitudinal axis of the drill bit. The down-the-hole drill hammer further comprises a clutch assembly operatively engaged with the drill bit. Additionally, the roller bearing assembly is distal to the clutch assembly.

In accordance with yet another aspect of the exemplary embodiment, the roller bearing assembly includes a second plurality of rollers circumscribing the drill bit and engaged with the race. The race includes a first circumferential recess for engaging the plurality of rollers and a second circumferential recess spaced from the first circumferential recess for engaging the second plurality of rollers. The plurality of rollers define a circumference substantially equal to a circumference defined by the second plurality of rollers. The plurality of rollers are axially spaced from the second plurality of rollers. The second plurality of rollers includes at least 4 rollers. The drill bit includes a shank having an impact surface and splines, and wherein the plurality of rollers and second plurality of rollers are positioned distally spaced from the impact surface and splines.

In accordance with yet another aspect of the exemplary embodiment, the roller bearing assembly includes a bearing circumscribing the drill bit and engaged with the race, wherein the bearing is axially spaced from the plurality of rollers.

BRIEF DESCRIPTION OF THE SEVERAL VIEWS OF THE DRAWINGS

The foregoing summary, as well as the following detailed description of the exemplary embodiments of the subject disclosure, will be better understood when read in conjunction with the appended drawings. For the purpose of illustrating the subject disclosure, there are shown in the drawings exemplary embodiments. It should be understood, however, that the invention is not limited to the precise arrangements and instrumentalities shown.

In the drawings.

DETAILED DESCRIPTION OF THE INVENTION

Figure 1:
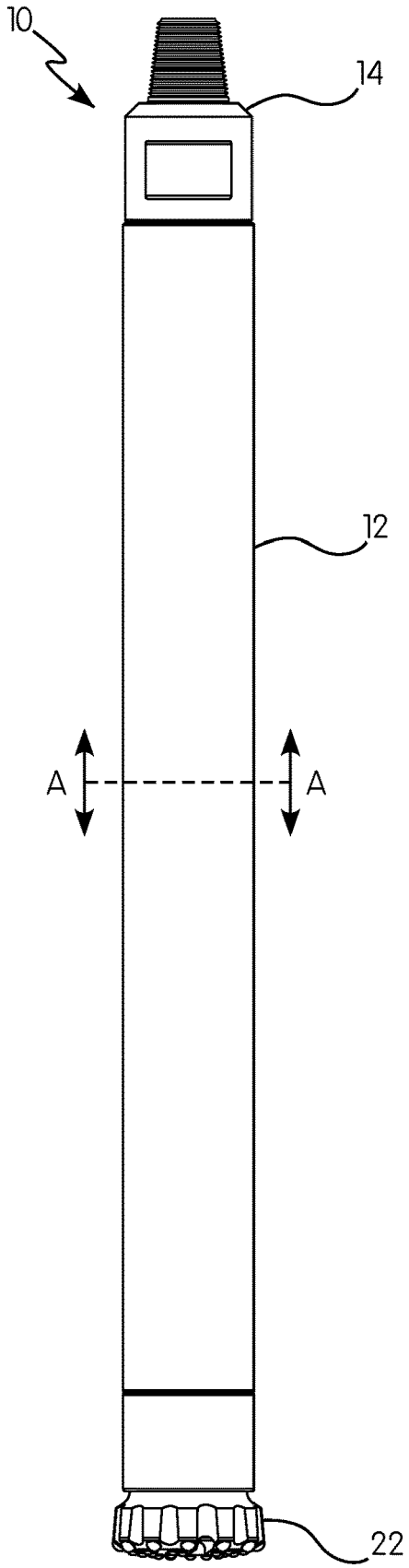
FIG. 1 is a side elevation view of a down-the-hole drill hammer in accordance with an exemplary embodiment of the subject disclosure.

Reference will now be made in detail to the exemplary embodiments of the subject disclosure illustrated in the accompanying drawings. Wherever possible, the same or like reference numbers will be used throughout the drawings to refer to the same or like features. It should be noted that the drawings are in simplified form and are not drawn to precise scale. In reference to the disclosure herein, for purposes of convenience and clarity only, directional terms such as top, bottom, above, below and diagonal, are used with respect to the accompanying drawings. The term "proximal" refers to being nearer to the center of a body or a point of attachment of a drill string to the DHD hammer. The term "distal" refers to being away from the center of a body or from the point of attachment of the drill string to the DHD hammer. Such directional terms used in conjunction with the following description of the drawings should not be construed to limit the scope of the invention in any manner not explicitly set forth. Additionally, the term "a," as used in the specification, means "at least one." The terminology includes the words above specifically mentioned, derivatives thereof, and words of similar import.

"About" as used herein when referring to a measurable value such as an amount, a temporal duration, and the like, is meant to encompass variations of ±20%, ±10%, ±5%, ±1%, and ±0.1% from the specified value, as such variations are appropriate.

"Substantially" as used herein shall mean considerable in extent, largely but not wholly that which is specified, or an appropriate variation therefrom as is acceptable within the field of art.

Ranges throughout this disclosure and various aspects of the invention can be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 2.7, 3, 4, 5, 5.3, and 6. This applies regardless of the breadth of the range.

Furthermore, the described features, advantages and characteristics of the exemplary embodiments may be combined in any suitable manner in one or more embodiments. One skilled in the relevant art will recognize, in light of the description herein, that the exemplary embodiments can be practiced without one or more of the specific features or advantages of a particular exemplary embodiment. In other instances, additional features and advantages may be recognized in certain embodiments that may not be present in all exemplary embodiments.

In accordance with an exemplary embodiment, the subject disclosure provides a down-the-hole drill hammer 10, as shown in FIGS. 1-7A, 8A, 9A and 9B. The DHD hammer 10 includes a housing or casing 12, a backhead 14, a piston 16, a roller ramp clutch 18, a coupler 20, a race 21, one or more sets of plurality of rollers 23A, 23B and a drill bit 22. The roller ramp clutch and coupler collectively form a clutch assembly 19. The clutch assembly circumscribes the piston and drill bit. The race and plurality of rollers collectively form a roller bearing assembly 25. The roller bearing assembly circumscribes the drill bit.

The housing 12 has a generally cylindrical configuration and at least partially or completely houses the backhead 14 and drill bit 16. The housing 12 also houses the piston 16 and the clutch assembly 19, as further described below.

The backhead 14 can be any conventional backhead readily used in DHD hammers. The structure and operation of such backheads are readily known in the art and a detailed description of them is not necessary for a complete understanding of the subject disclosure. However, exemplary backheads suitable for use in the present exemplary embodiments are described in, e.g., U.S. Pat. Nos. 5,711,205 and 8,397,839, the entire disclosures of which are hereby incorporated by reference for all purposes.

FIGS. 5-8A best illustrate the drill bit 22. The drill bit 22 is proximate a distal end of the housing and connected to the DHD hammer about its distal end. The drill bit 22 is a single piece constructed part and is configured with a head 24 and a shank 26. The head 24 is generally configured similarly to conventional heads used in DHD hammers and includes a plurality of inserts (also known as cutting inserts).

Figure 2:
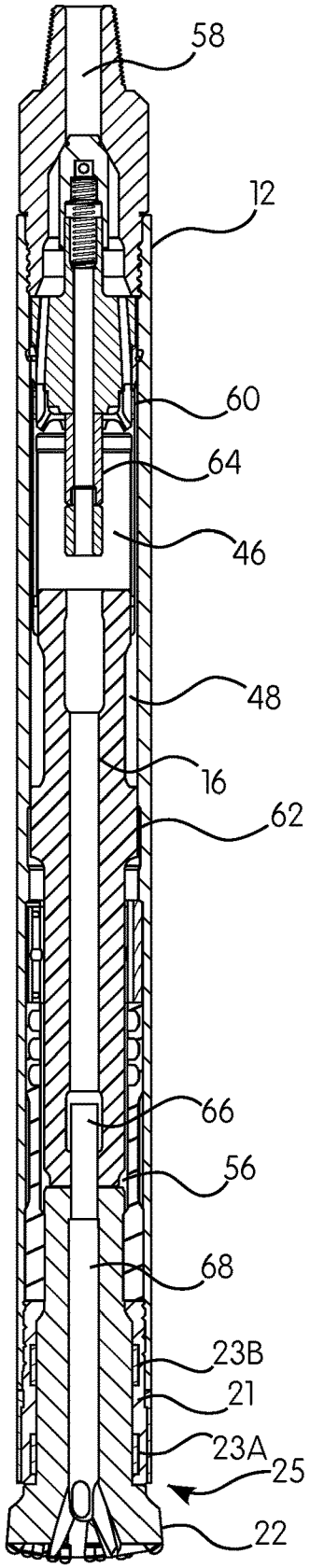
FIG. 2 is a cross-sectional side elevation view of the down-the-hole drill hammer of FIG. 1 taken along A-A.
Figure 3:
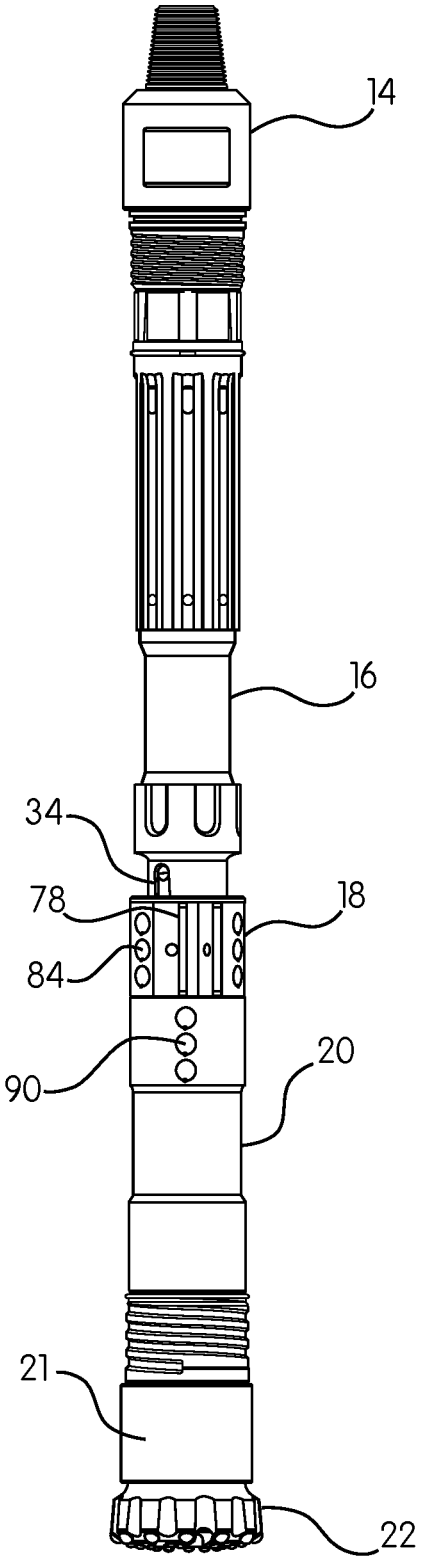
FIG. 3 is a side elevation view of the down-the-hole drill hammer of FIG. 1 without a housing.
Figure 4:
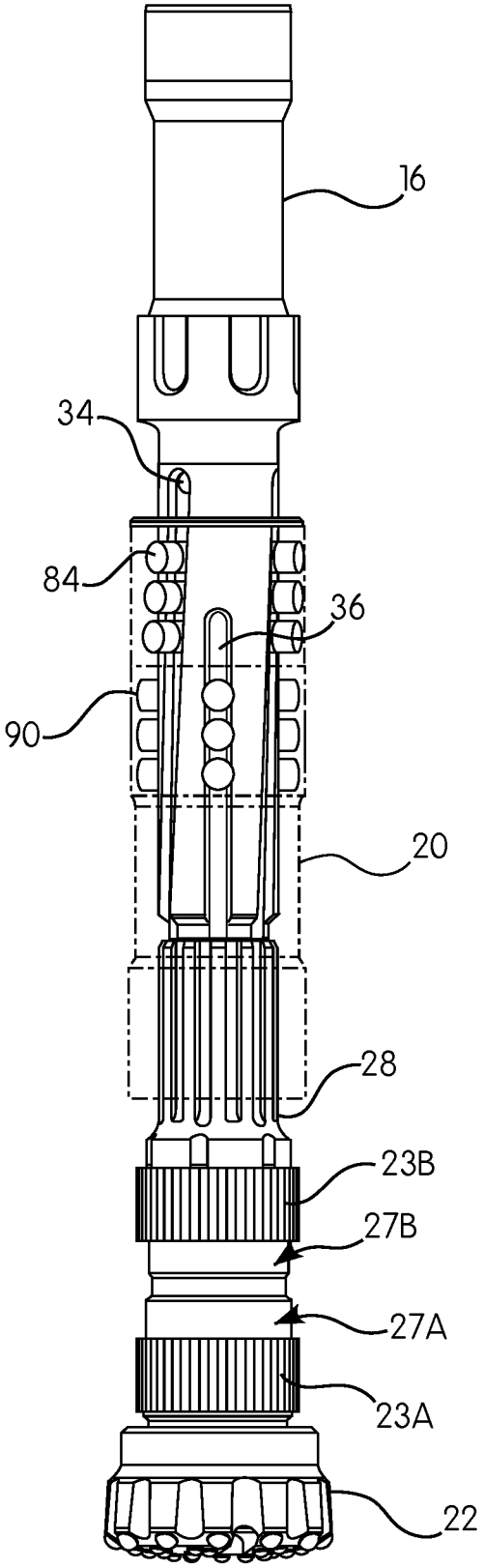
FIG. 4 is a side elevation view of a bottom portion of the down-the-hole drill hammer of FIG. 3 without a race and certain other parts omitted for purposes of illustration.

The shank 26 of the drill bit 22 is configured with a plurality of circumferentially spaced splines 28 at its proximal end having an overall diameter that is slightly smaller than a body 30 of the shank, as best shown in FIG. 2. The splines 28 are configured to engage complimentary splines 32 on the coupler. The shank further includes an impact surface 31 proximal from the splines which operatively engages the piston 16.

Figure 5:
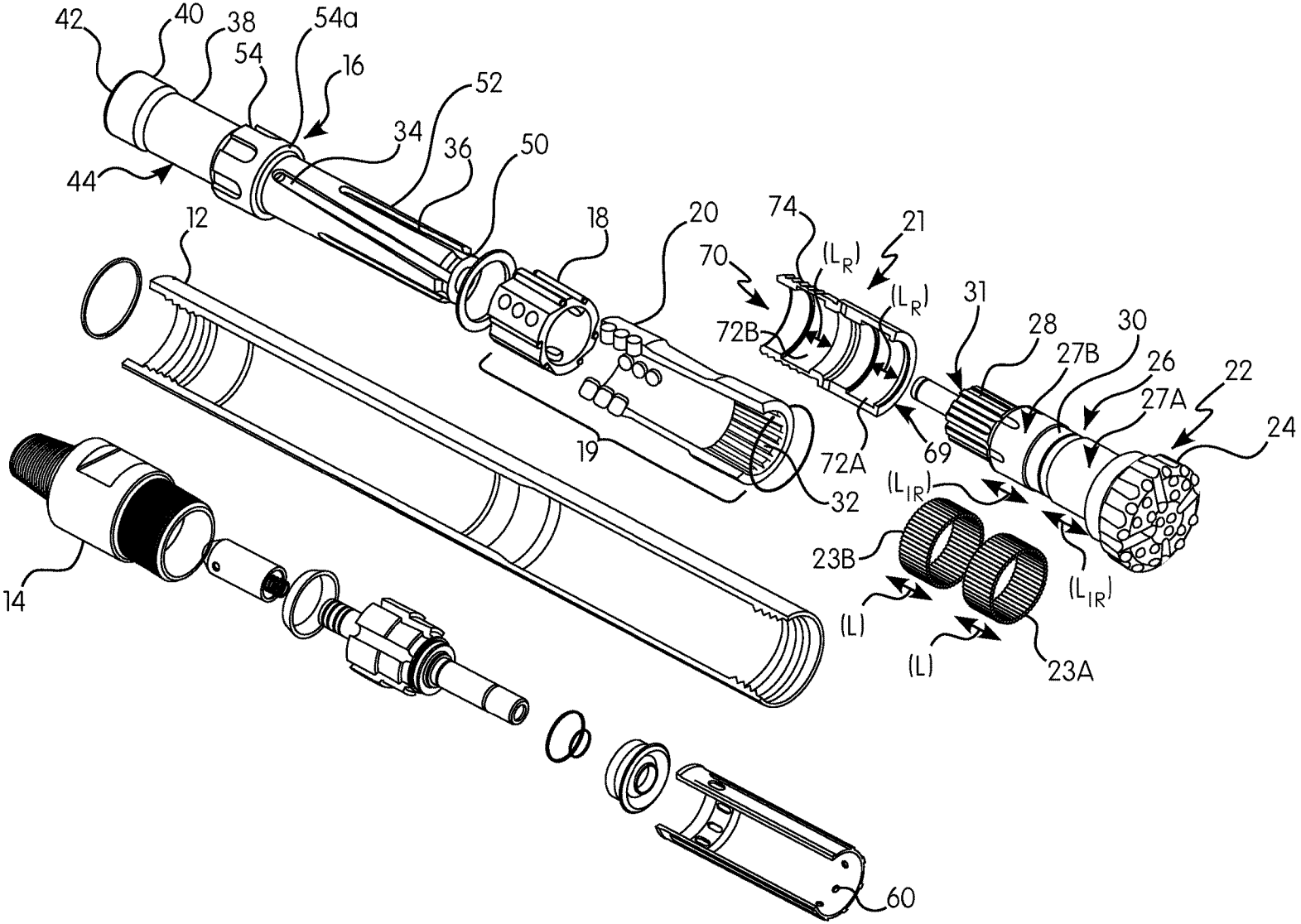
FIG. 5 is an exploded perspective view of the down-the-hole drill hammer of FIG. 1 with certain components including a coupler, a casing and a race shown in cross-section for purposes of illustration.
Figure 7A:
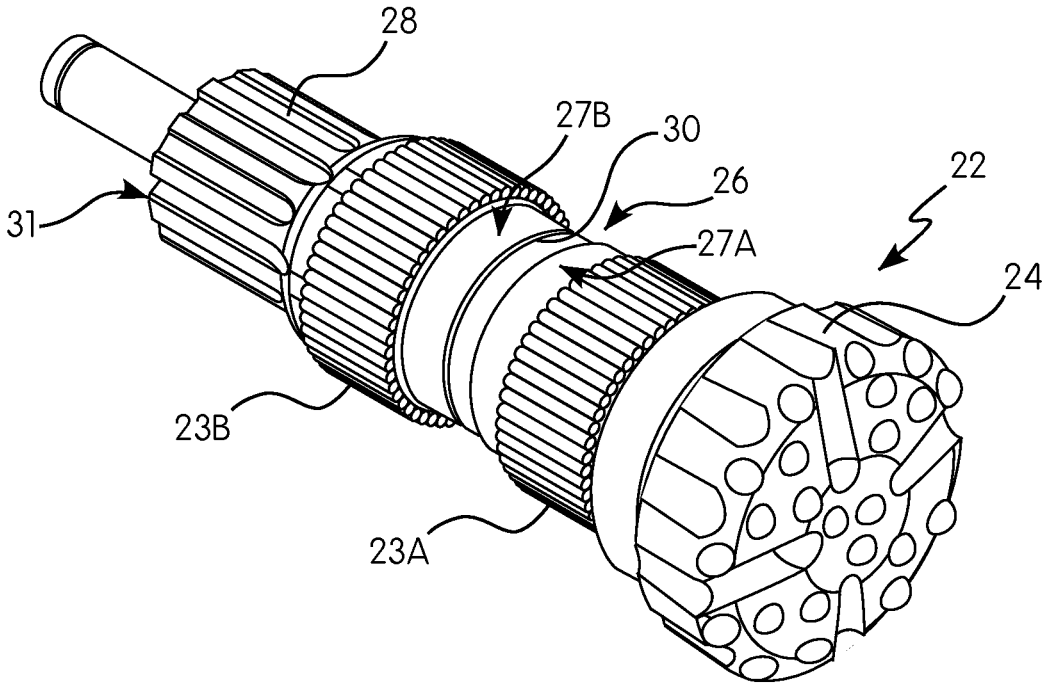
FIG. 7A is a perspective view of a drill bit and plurality of rollers of a roller bearing assembly for the down-the-hole drill hammer of FIG. 1 with certain components omitted.
Figure 8A:
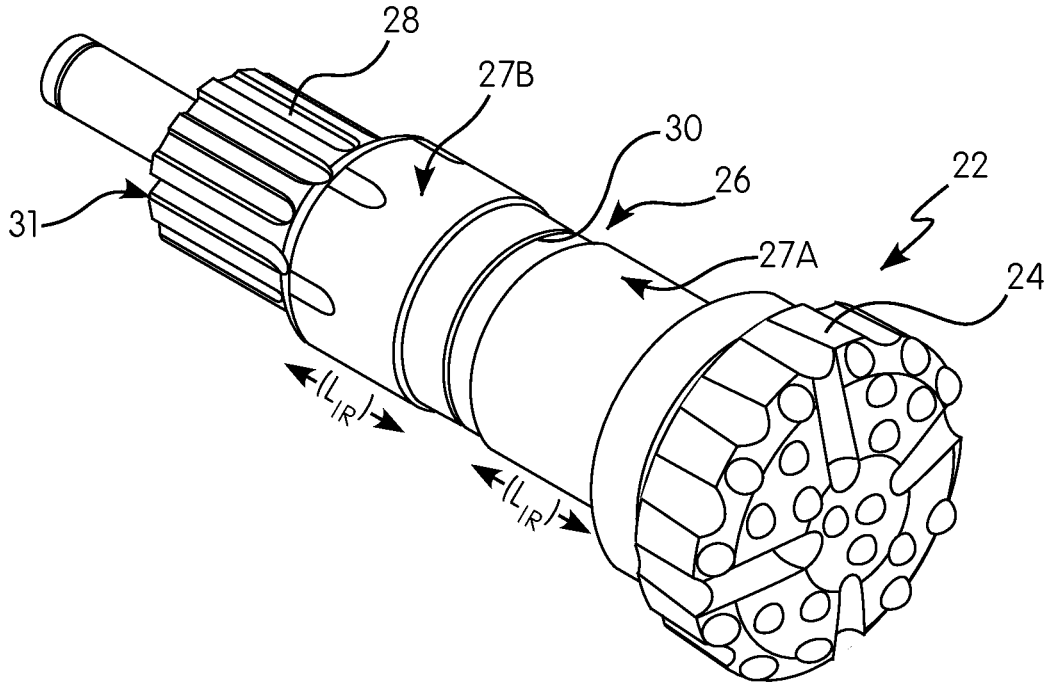
FIG. 8A is a perspective view of the drill bit shown in FIG. 7A.
Figure 8B:
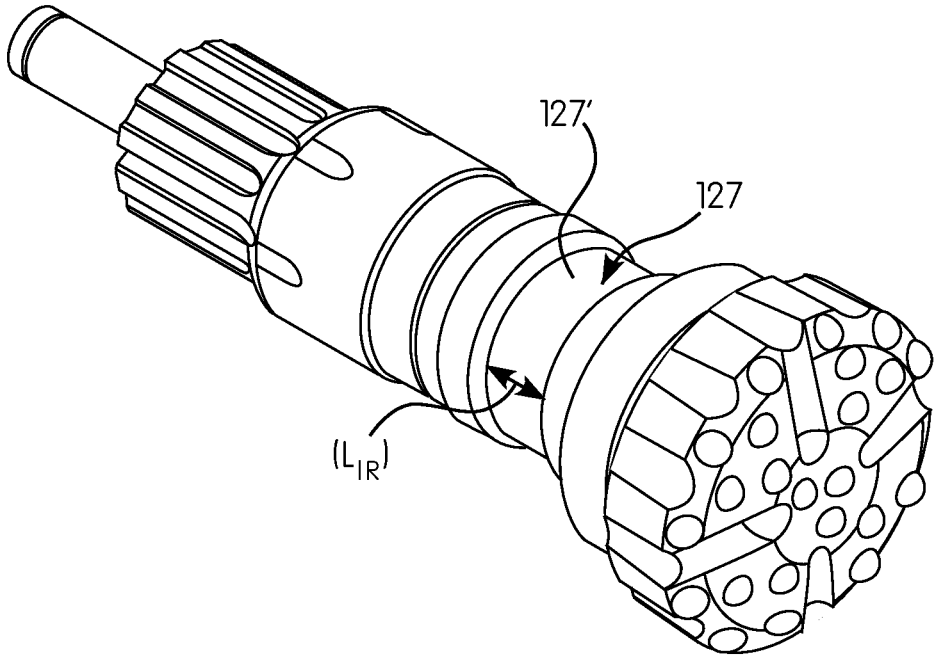
FIG. 8B is a perspective view of a drill bit in accordance with another exemplary embodiment of the subject disclosure.

As best shown in FIGS. 5, 7A and 8A, the body 30 of the drill bit 22 defines one or more inner surfaces or inner races 27A, 27B configured to slidably engage the sets of plurality of rollers 23A, 23B. In an exemplary embodiment, the inner races are configured as being substantially cylindrical and are positioned adjacent to the head 24 (inner race 27A) or adjacent to the splines 28 (inner race 27B). In an exemplary embodiment, the inner races can be the surfaces of the body or recesses configured to receive the plurality of rollers 23A. For example, as shown in FIG. 8B, the inner race 127 can be defined by a recess 127' circumscribing the body 30 which is sized and shaped to receive the plurality of rollers. In other words, the drill bit includes a shank having a recess circumscribing the shank and defining an inner race for engaging the plurality of rollers. Additionally, in an exemplary embodiment, the inner races have a longitudinal length ($L_{IR}$) greater than a longitudinal length (L) of any one of the plurality of rollers 23A, 23B.

Figure 8C:
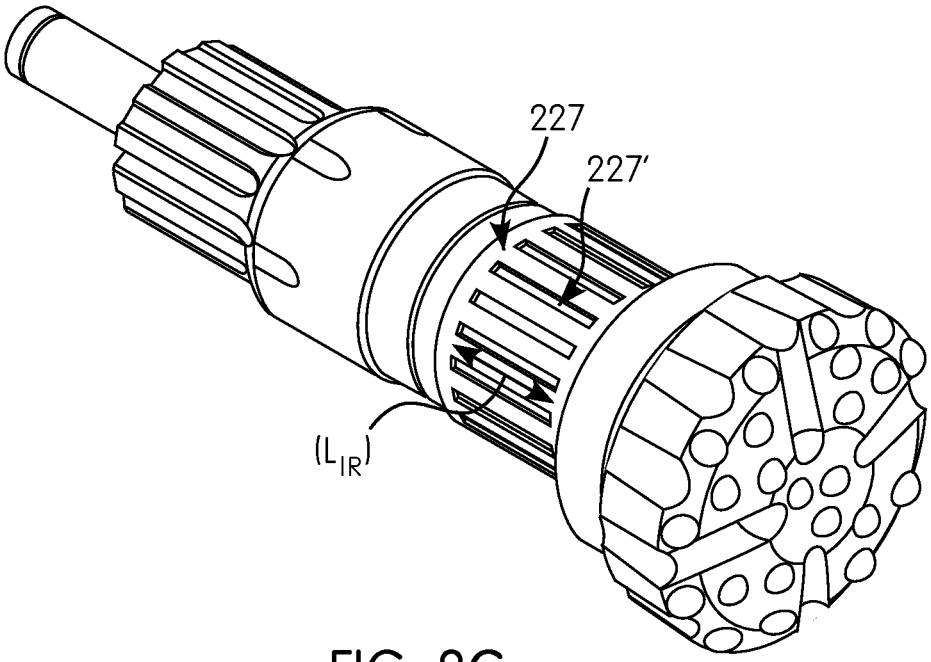
FIG. 8C is a perspective view of a drill bit in accordance with yet another exemplary embodiment of the subject disclosure.

Referring to FIG. 8C, in accordance with another exemplary embodiment, the inner race 227 can be defined by a plurality of grooves 227' which are each sized and shaped to receive one of the rollers of the plurality of rollers 23A. Each of the plurality of grooves 227' are arranged about the body of the drill bit such that their longitudinal axes are parallel or substantially parallel to a longitudinal axis of the drill bit. In other words, the drill bit includes a shank having a plurality of grooves circumscribing the shank and configured to receive the plurality of rollers.

The piston 16 is configured as best shown in FIGS. 2 and 5. The piston is configured to reciprocally move within the housing 12 along a longitudinal axial direction of the housing. The piston includes a helical spline 34 and an axial spline 36 about its lower half or distal portion. Preferably, the piston includes three helical splines and three axial splines evenly and circumferentially spaced apart in an alternating fashion about a surface of the piston. However, other arrangements in number and size, and spacing of the axial splines and/or the helical splines may be used. Each helical spline 34 is circumferentially spaced from an adjacent axial spline.

The helical and straight axial splines 34, 36 are preferably configured as female splines. The axial splines 36 run generally parallel with a central longitudinal axis of the piston 16. The helical splines 34 are configured to run in a generally helical fashion, such that upon movement of the piston 16 in the distal direction, the helical splines 34 function to rotate and lock the roller ramp clutch.

The piston's proximal end includes a smaller diameter section 38, a larger diameter section 40 and a drive surface 42. The areas generally encompassing the smaller diameter section 38, the larger diameter section 40, and the drive surface 42 comprise a piston drive area 44. The drive surface 42 in combination with the inner wall of the housing 12 generally comprise a driver chamber 46 while the larger diameter section 40 and the smaller diameter section 38 in combination with the inner wall of the housing 12 generally comprise a reservoir 48.

The area generally encompassing the distal end face 50, an outer surface 52 and a distal edge 54*a* of a larger diameter section 54 of the piston 16 comprise a piston return area or return chamber 56. By alternating between high (supply) and low (exhaust) pressures within the piston drive chamber 46 and piston return area 56, the piston 16 is cycled axially to induce percussive forces on the drill bit 22. The alternating high and low pressure is cycled through the DHD hammer 10 through conventional porting within the DHD hammer as best shown in FIG. 2. Such porting of DHD hammers are known in the art and a detailed description of them is not necessary for a complete understanding of the present embodiment.

However, as shown in FIG. 2, such porting systems can include a central port 58, blow ports 60, a lower piston seal path 62, an exhaust valve stem 64, an exhaust tube 66 and a central bit flushing port 68. The porting system as shown provides a fluid passageway which allows for supply flow to compress and exhaust working air pressures within the drive chamber 46, reservoir 48 and return chamber 56 to reciprocally drive the piston 16 within the housing 12.

The roller ramp clutch 18 and coupler 20 are configured as best shown in FIG. 5. The roller ramp clutch and coupler collectively form the clutch assembly 19. An exemplary embodiment of a roller ramp clutch applicable to the subject disclosure is disclosed in U.S. Patent Application Publication No. 2016/0222732, the entire disclosure of which is incorporated by reference herein. Additionally, while the disclosed clutch assembly is preferred, alternative clutch assemblies can be used with the present exemplary embodiment, such as wire spring clutches disclosed in U.S. Pat. No. 8,397,839, the entire disclosure of which is incorporated by reference herein.

Figure 6:
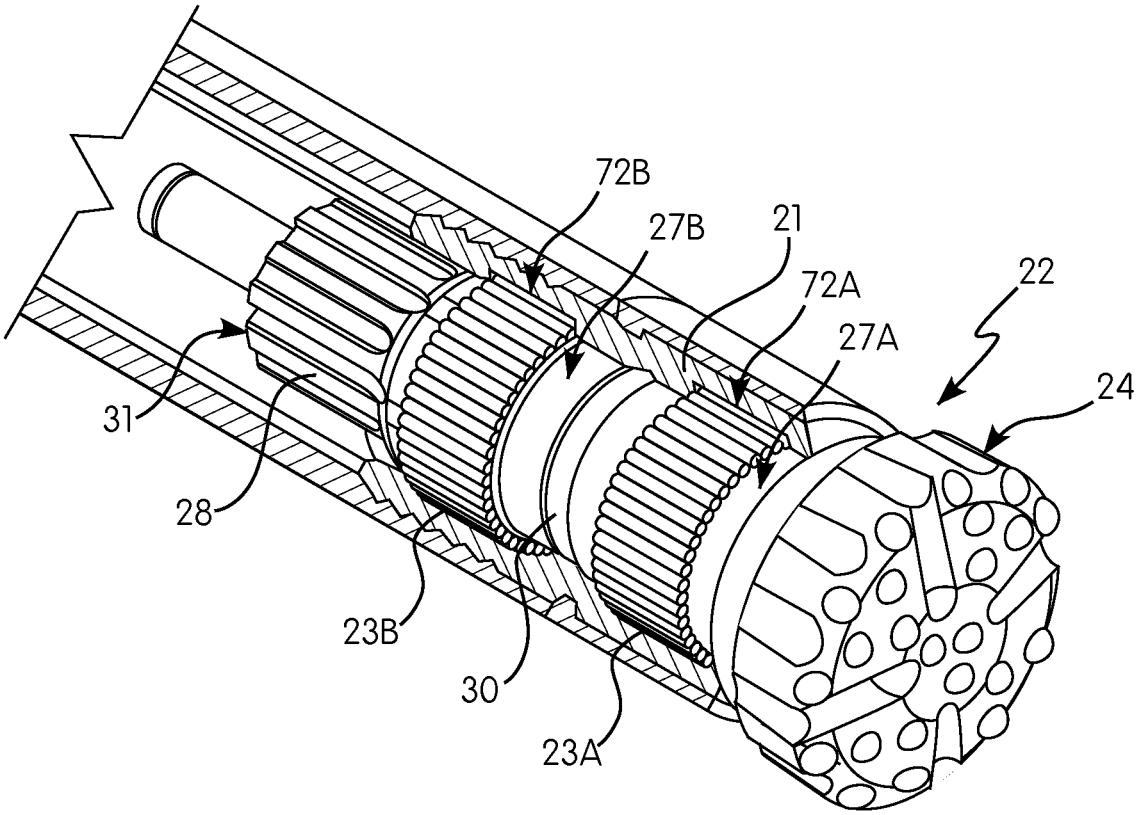
FIG. 6 is a partial cross-sectional perspective view of a distal end of the down-the-hole drill hammer of FIG. 1.
Figure 9A:
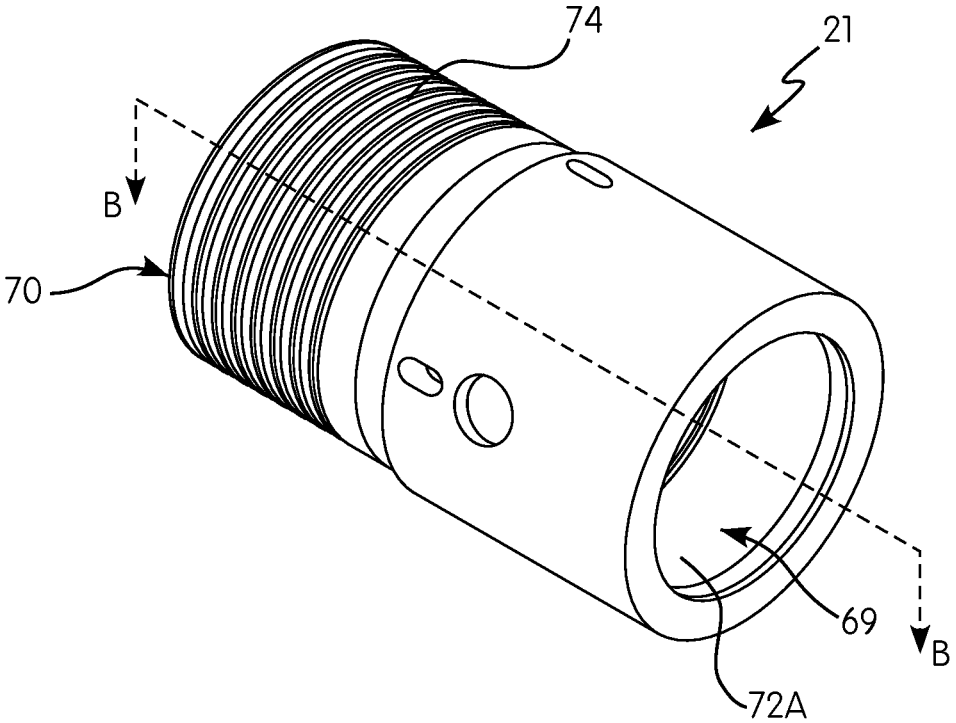
FIG. 9A is a perspective view of a race in accordance with an exemplary embodiment of the subject disclosure.
Figure 9B:
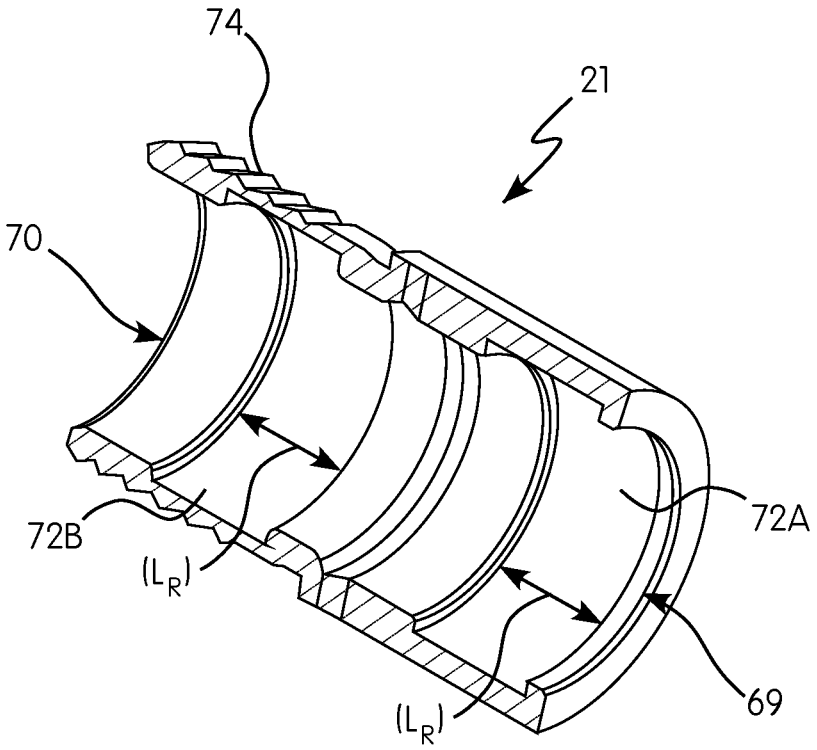
FIG. 9B is a cross-sectional perspective view of the race of FIG. 9A taken along B-B.
Figure 10:
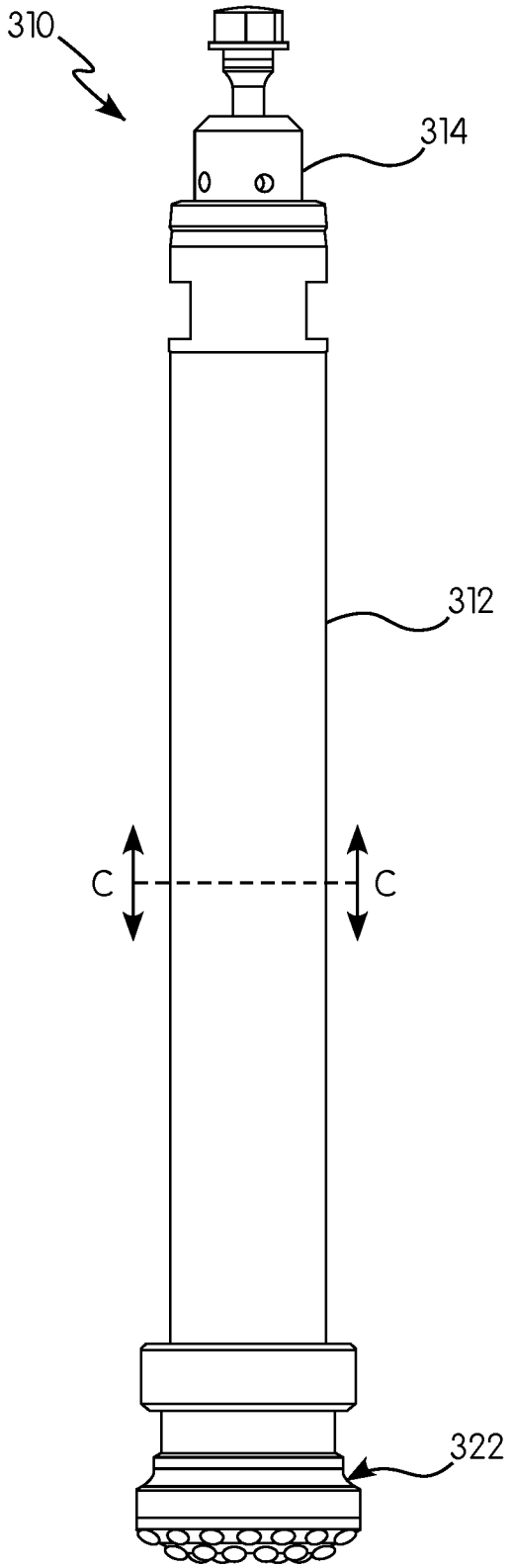
FIG. 10 is a side elevation view of a down-the-hole drill hammer in accordance with another exemplary embodiment of the subject disclosure.
Figure 11:
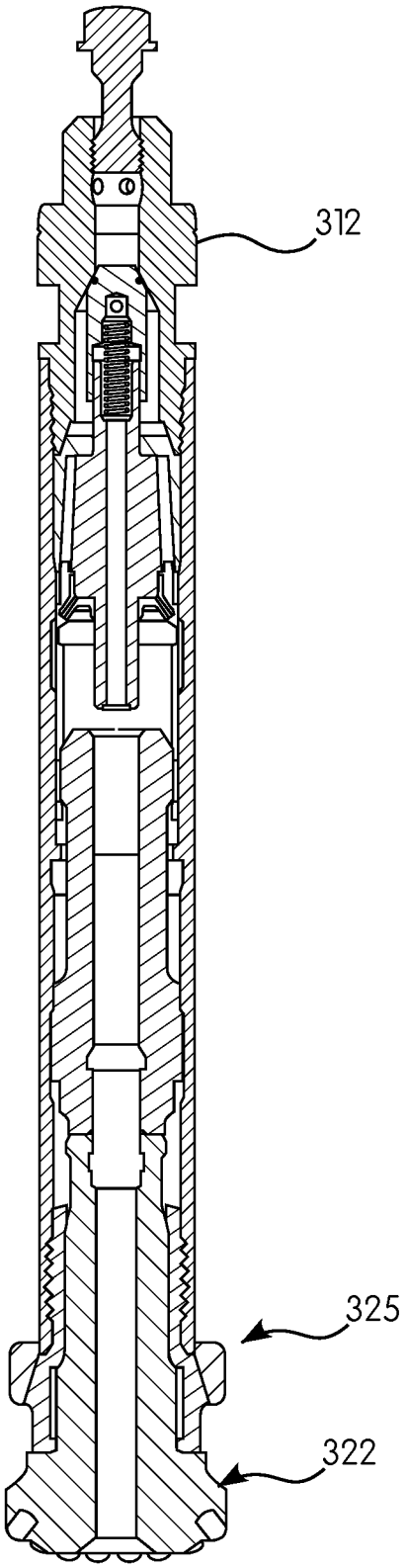
FIG. 11 is a cross-sectional side elevation view of the down-the-hole drill hammer of FIG. 10 taken along C-C.

As best shown in FIGS. 5, 9A and 9B, the race 21 is configured as a substantially annular member sized and shaped to receive the body 30 of the drill bit 22. In an exemplary embodiment, the race includes a distal end 69, a proximal end 70 and one or more recesses 72A, 72B, i.e., outer races. In an exemplary embodiment, the recesses 72A, 72B are formed about the distal end and proximal end of the race, respectively. Each of the recesses 72A, 72B circumscribe inner surfaces of the race 21 and are each sized and shaped to receive one set of the plurality of rollers 23A, 23B. Specifically, the recesses 72A, 72B have a longitudinal length ($L_R$) and a depth sufficiently sized to receive the plurality of rollers 23A, 23B therewithin such that the plurality of rollers are fixed in position from moving in an axial direction, as shown in FIG. 6. In an exemplary embodiment, the longitudinal length ($L_R$) could be substantially equal to and/or marginally greater than the longitudinal length (L) of the plurality of rollers 23A, 23B. In other words, the race includes a distal end having a circumferential recess for engaging the plurality of rollers.

The proximal end includes a fastener 74 configured to secure to the housing 12. In an exemplary embodiment, the fastener is configured as a male or female thread for engaging corresponding threads on the housing. In other words, the race includes a proximal end connected to the housing.

As best shown in FIGS. 5 and 7A, each set of the plurality of rollers 23A, 23B are configured to movably or rotatably engage the inner races 27A, 27B of the drill bit's body 30 and movably or rotatably engage the recesses 72A, 72B of the race 21, respectively. Specifically, each of the plurality of rollers have a longitudinal length (L) less than a longitudinal length ($L_{IR}$) of the inner race 27A or 27B, when aligned substantially in parallel to one another. The configuration of the plurality of rollers and inner races allow or permit axial motion along the longitudinal length of the drill bit 22. In an exemplary embodiment, the plurality of rollers are substantially cylindrical in shape having their longitudinal length (L) arranged substantially parallel the longitudinal axis of the piston. In other words, a longitudinal axis of each of the plurality of rollers is substantially parallel with a longitudinal axis of the drill bit.

The roller bearing assembly 25 includes a sufficient number of rollers to completely or partially circumscribe each of the inner races of the drill bit 22. In an exemplary embodiment, the number of rollers is sufficient to allow each roller of each set of the plurality of rollers 23A or 23B to be adjacent and/or be in contacting engagement to one another. However, the subject disclosure permits the use of a number of rollers such that each of the rollers of an individual set (e.g., 23A) are spaced from one another. It is therefore appreciated that the number of rollers can be greater than and/or less than what is shown in the drawings. In other words, the exemplary embodiments can employ 2, 5, 10, 20, 30, 40, 50, 60 or more rollers for an individual set of plurality of rollers. In an exemplary embodiment, the roller bearing assembly includes 43 rollers for each of the inner races 27A, 27B.

As best shown in FIGS. 1-4 and 6, when fully assembled, the roller bearing assembly 25 is secured about the drill bit 22 and to the housing 12. Specifically, the body 30 of the drill bit 22 is circumscribed by the plurality of rollers 23A, 23B at the inner races 27A, 27B, respectively. The race 21 circumscribes the drill bit 22 and is positioned such that a set of the plurality of rollers are positioned between each pair of inner races of the body 30 and the recesses of the race 21. As such, each set of the plurality of rollers are axially secured within the respective recess while being permitted to rotate therein about their own longitudinal axes. Additionally, each inner race slidably engages the respective set of plurality of rollers along the longitudinal length ($L_{IR}$) of the inner race. That is, owing to the difference in longitudinal length ($L_{IR}$) of the inner race and the longitudinal length (L) of individual rollers, as described above, the arrangement permits some axial movement or play between the drill bit and roller bearing assembly. The race 21 is fixedly secured to the housing 12 via the fastener 74. Further, the drill bit 22 is operatively connected to the coupler via the splines 28 and complementary splines 32.

In other words, the down-the-hole drill hammer comprises a housing, a drill bit proximate a distal end of the housing, and a roller bearing assembly circumscribing the drill bit. The roller bearing assembly includes a race and a plurality of rollers operatively engaged with the race. The race is connected to the housing and/or fixedly connected to the housing. The race circumscribes the drill bit, the plurality of rollers, and a shank of the drill bit. The down-the-hole drill hammer further comprises a clutch assembly operatively engaged with the drill bit, wherein the roller bearing assembly is distal to the clutch assembly.

Additionally, the roller bearing assembly includes a second plurality of rollers circumscribing the drill bit and engaged with the race. The race includes a first circumferential recess for engaging the plurality of rollers and a second circumferential recess spaced from the first circumferential recess for engaging the second plurality of rollers. The plurality of rollers defines a circumference substantially equal to a circumference defined by the second plurality of rollers. The plurality of rollers is axially spaced from the second plurality of rollers. The second plurality of rollers includes at least 4 rollers. The drill bit includes a shank having an impact surface and splines, and wherein the plurality of rollers and second plurality of rollers are positioned distally spaced from the impact surface and splines.

Figure 7B:
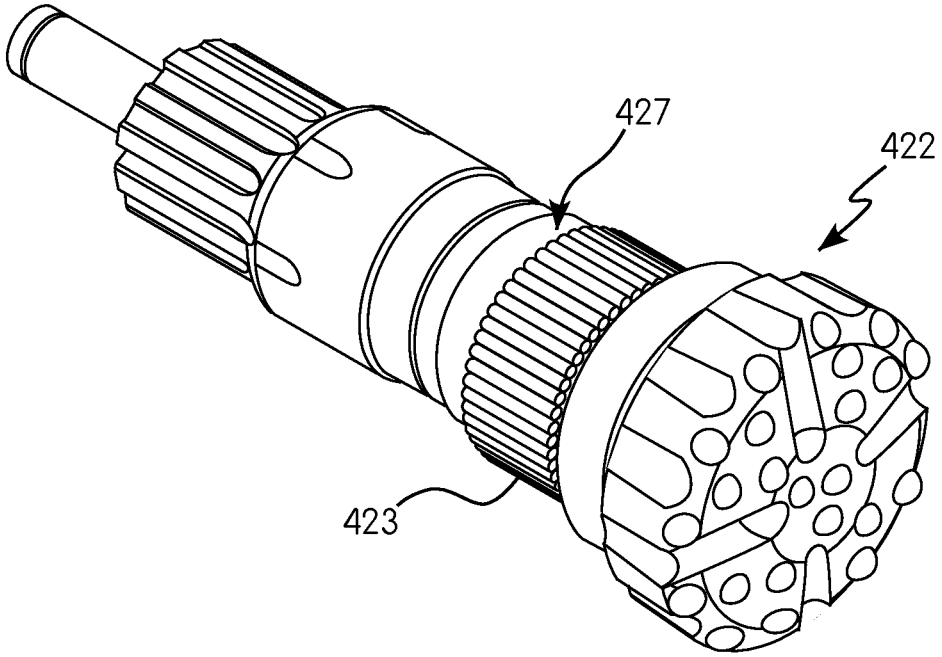
FIG. 7B is a perspective view of a drill bit and a plurality of rollers for a roller bearing assembly in accordance with another exemplary embodiment of the subject disclosure.

As best shown in FIG. 7B, in accordance with another exemplary embodiment, the roller bearing assembly can be formed with only a single set of plurality of rollers 423 with a respective inner race 427 and race recess. It is appreciated that the arrangement and construction of the foregoing elements is similar or substantially similar to the roller bearing assembly 25 described above except that the drill bit 422 includes only a single inner race and a single outer race defined by a recess in the race.

Alternatively, in accordance with an alternative exemplary embodiment, the subject disclosure can be arranged to include any number of sets of rollers, inner races and recesses in the race including, for example, three, four, five, six or more in accordance with the teachings of the subject disclosure.

Figure 12:
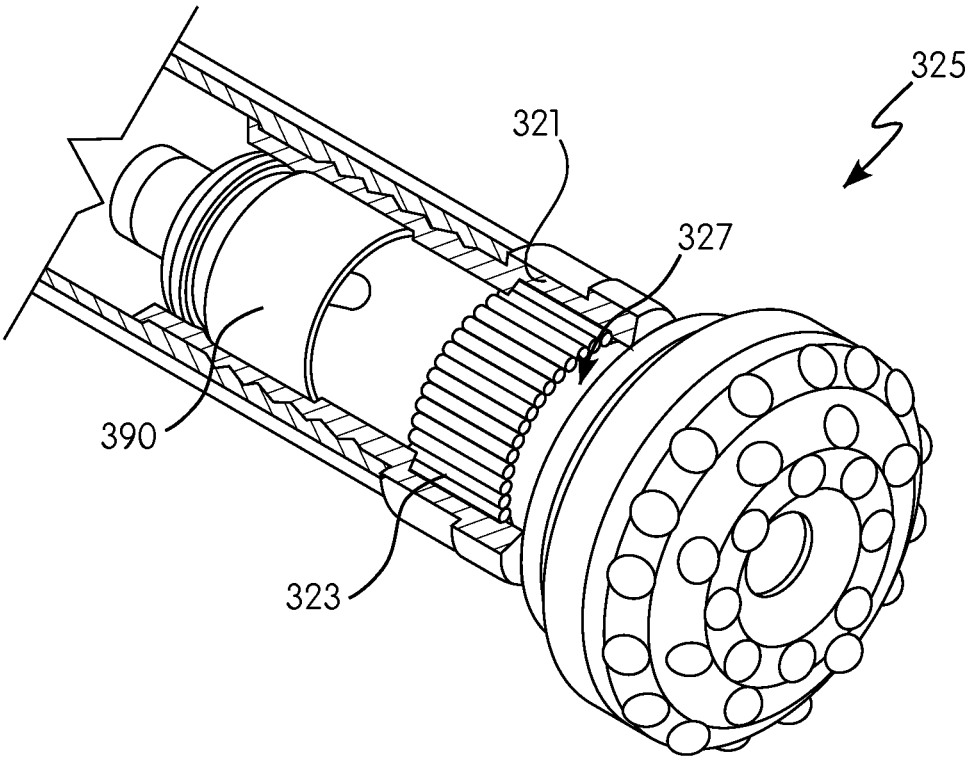
FIG. 12 is a partial cross-sectional perspective view of a distal end of the down-the-hole drill hammer of FIG. 10.
Figure 13:
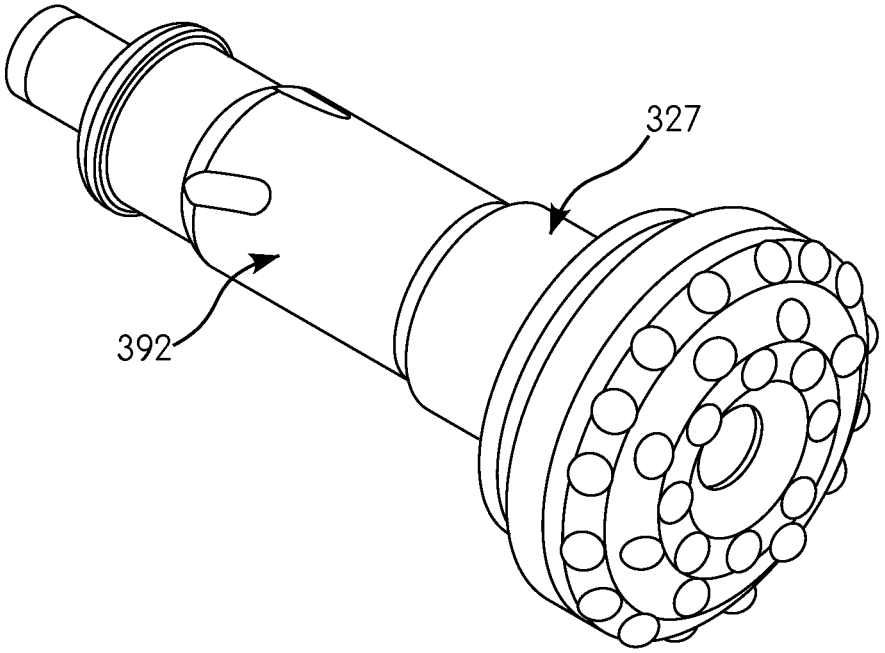
FIG. 13 is a perspective view of a drill bit of the down-the-hole drill hammer of FIG. 10.
Figure 14A:
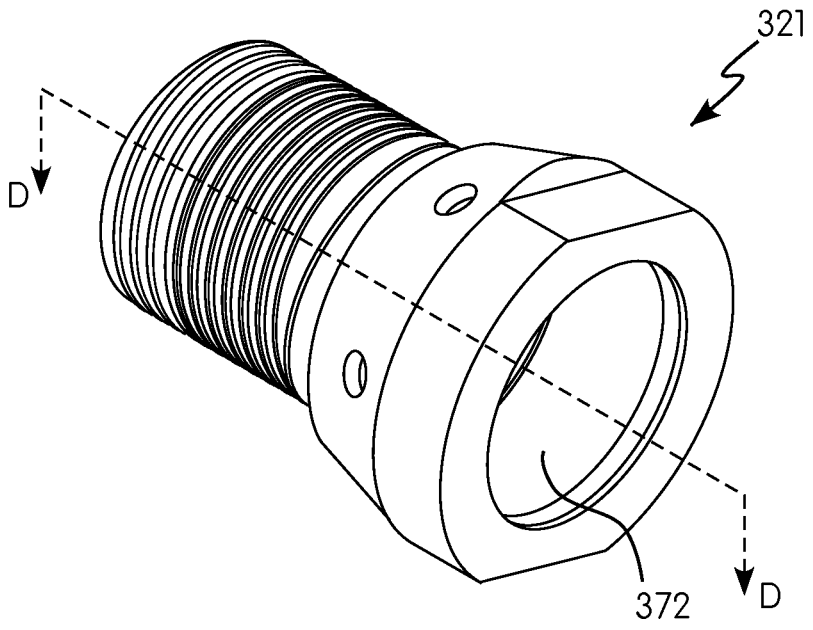
FIG. 14A is a perspective view of a race of a roller bearing assembly for the down-the-hole drill hammer of FIG. 10.
Figure 14B:
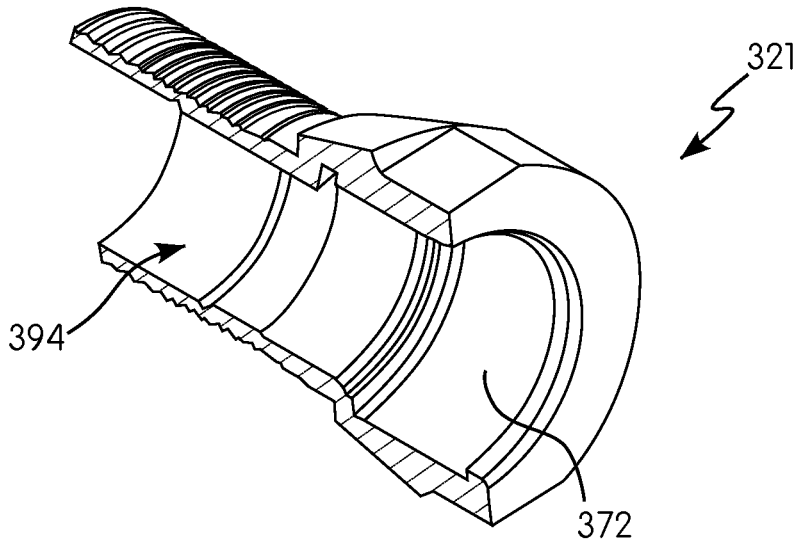
FIG. 14B is a cross-sectional perspective view of the race of FIG. 14A taken along D-D.

Referring to FIG. 12, the DHD hammer can also include additional bearings about the drill bit to facilitate operation of the DHD hammer in conjunction with the roller bearing assembly described above having a single set of plurality of rollers. The roller bearing assembly can also include a bearing circumscribing the drill bit and engaged with the race. As such, the bearing would be axially spaced from the plurality of rollers.

Referring to FIGS. 10-14B, in accordance with another exemplary embodiment, the subject disclosure provides a DHD hammer 310 and roller bearing assembly 325 configured substantially as shown. The DHD hammer 310 includes a housing 312, a backhead 314, a piston 316, and a drill bit 322. The roller bearing assembly 325 is similar or substantially similar to the roller bearing assembly 25, and includes a race 321 having a recess 372 as the outer race, an inner race 327 circumscribing the drill bit 322, and a plurality of rollers 323 positioned between the inner race and recess. Further, the race includes a fastener for attaching to the housing, similar to race 21. The DHD hammer can optionally include an additional bearing, such as bearing 390. Bearing 390 is spaced from the plurality of rollers 323 and operatively engages corresponding receiving surfaces 392, 394 of the drill bit 322 and race 321, respectively.

In operation, when the drill bit is rotated, each of the plurality of rollers rotate freely about their own longitudinal axes and minimize friction and wear between the race and the drill bit. Further, as the piston engages the drill bit, the drill bit moves axially along its longitudinal axis while rotating about its rotational axis. The rotation of the drill bit causes the plurality of rollers to rotate about their own longitudinal axes. Additionally, because of the arrangement of the roller bearing assembly, the plurality of rollers and the drill bit can continuously engage one another even when the drill bit and/or plurality of rollers move in an axial direction.

EXPERIMENTAL DATA

Invention Embodiment

A 24 inch diameter multi-hammer containing four hammers and a roller bearing assembly containing one set of 43 roller bearings operatively connected to the drill bit.

Conventional Drill Hammer:

A 24 inch diameter multi-hammer containing four hammers and a pair of Manganese Bronze journal bearings operatively connected to the drill bit.

Evaluation Method:

Each of the Invention Embodiment and Conventional Drill Hammer were operated under normal drilling conditions for drilling a 24 inch hole into earth.

Results:

1) The Conventional Drill Hammer required maintenance and/or replacement at about 110 feet. 2) The Invention Embodiment drilled to a depth of 220 feet and showed approximately 50% less wear-and-tear of the roller bearing assembly than the journal bearings of the Conventional Drill Hammer at 110 feet. The wear rate of the roller bearing assembly was roughly one-third the wear rate of the Manganese Bronze journal bearings in the Conventional Drill Hammer.

The advantages of the above-described roller bearing assemblies are apparent. For example, traditional down-the-hole drill hammers that utilize journal bearings about their drill bit are less effective in enduring side loads and wear out after a relatively short use time frame. The subject disclosure incorporates a plurality of rollers that serve as bearings and enable a rolling engagement between the drill bit and housing, as opposed to typical bearings which enable a sliding engagement therebetween. These rollers advantageously facilitate and reduce component wear between the roller bearing assembly, housing and drill bit, for example by reducing the coefficient of friction therebetween via rolling. Consequently, the life expectancy of the above-described roller bearing assembly is significantly more than a standard bearing assembly, such as those utilizing solely journal bearings. Therefore, the maintenance time and cost are significantly reduced. Further, efficiency of the down-the-hole drill hammers of the subject disclosure are also increased because the hammers can operate to greater depths without needing maintenance.

It will be appreciated by those skilled in the art that changes could be made to the exemplary embodiments described above without departing from the broad inventive concept thereof. It is to be understood, therefore, that this invention is not limited to the particular embodiments disclosed, but it is intended to cover modifications within the spirit and scope of the subject disclosure as defined by the claims.

I claim:

1. A down-the-hole drill hammer comprising:

a housing;

a drill bit proximate a distal end of the housing; and a roller bearing assembly circumscribing the drill bit, the roller bearing assembly including:

a race, a plurality of rollers operatively engaged with the race, and a bearing circumscribing the drill bit and engaged with the race, wherein the bearing is axially spaced from the plurality of rollers.

2. The down-the-hole drill hammer of claim 1, wherein the race is connected to the housing.

3. The down-the-hole drill hammer of claim 1, wherein the race is fixedly connected to the housing.

4. The down-the-hole drill hammer of claim 1, wherein the race circumscribes the drill bit.

5. The down-the-hole drill hammer of claim 1, wherein the race circumscribes the plurality of rollers.

6. The down-the-hole drill hammer of claim 1, wherein the race circumscribes a shank of the drill bit.

7. The down-the-hole drill hammer of claim 1, wherein the race includes a distal end having a circumferential recess for engaging the plurality of rollers and a proximal end connected to the housing.

8. The down-the-hole drill hammer of claim 7, wherein the proximal end of the race includes threads for engaging the housing.

9. The down-the-hole drill hammer of claim 1, wherein the drill bit includes a shank having a recess circumscribing the shank and defining an inner race for engaging the plurality of rollers.

10. The down-the-hole drill hammer of claim 1, wherein the drill bit includes a shank having a plurality of grooves circumscribing the shank and configured to receive the plurality of rollers.

11. The down-the-hole drill hammer of claim 1, wherein the plurality of rollers includes at least 4 rollers.

12. The down-the-hole drill hammer of claim 1, wherein a longitudinal axis of each of the plurality of rollers is substantially parallel with a longitudinal axis of the drill bit.

13. A down-the-hole drill hammer comprising:

a housing;

a drill bit proximate a distal end of the housing;

a roller bearing assembly circumscribing the drill bit, the roller bearing assembly including: a race, and a plurality of rollers operatively engaged with the race; and a clutch assembly operatively engaged with the drill bit, wherein the roller bearing assembly is distal to the clutch assembly.

14. The down-the-hole drill hammer of claim 1, wherein the bearing comprises a second plurality of rollers.

15. The down-the-hole drill hammer of claim 14, wherein the race includes a first circumferential recess for engaging the plurality of rollers and a second circumferential recess spaced from the first circumferential recess for engaging the second plurality of rollers.

16. The down-the-hole drill hammer of claim 14, wherein the plurality of rollers define a circumference substantially equal to a circumference defined by the second plurality of rollers.

17. The down-the-hole drill hammer of claim 14, wherein the second plurality of rollers includes at least 4 rollers.

18. The down-the-hole drill hammer of claim 14, wherein the drill bit includes a shank having an impact surface and splines, and wherein the plurality of rollers and second plurality of rollers are positioned distally spaced from the impact surface and splines.

19. The down-the-hole drill hammer of claim 13, wherein the race circumscribes the drill bit.

20. The down-the-hole drill hammer of claim 13, wherein the race circumscribes the plurality of rollers.

* * * * *